US006177192B1

(12) United States Patent
Asano et al.

(10) Patent No.: US 6,177,192 B1
(45) Date of Patent: Jan. 23, 2001

(54) POLYETHYLENE NAPHTHALATE FIBER

(75) Inventors: Makoto Asano, Kanagawa; Toshimasa Kuroda, Osaka; Ryoji Tsukamoto; Toshihiro Santa, both of Ehime, all of (JP)

(73) Assignee: Teijin Limited, Osaka (JP)

( * ) Notice: Under 35 U.S.C. 154(b), the term of this patent shall be extended for 0 days.

(21) Appl. No.: 09/424,083

(22) PCT Filed: Mar. 25, 1998

(86) PCT No.: PCT/JP98/01333

§ 371 Date: Nov. 19, 1999

§ 102(e) Date: Nov. 19, 1999

(87) PCT Pub. No.: WO99/49112

PCT Pub. Date: Sep. 30, 1999

(51) Int. Cl.[7] ..... D01F 6/00; D01F 6/62
(52) U.S. Cl. ..... 428/364; 428/395
(58) Field of Search ..... 424/364, 395

(56) References Cited

U.S. PATENT DOCUMENTS 5,023,390 * 6/1991 Abe ..... 585/320

FOREIGN PATENT DOCUMENTS 43-29741 5/1968 (JP) .
46-30973 9/1971 (JP) .

* cited by examiner

*Primary Examiner*—Newton Edwards
(74) *Attorney, Agent, or Firm*—Sughrue, Mion, Zinn, Macpeak & Seas, PLLC

(57) ABSTRACT

A polyethylene naphthalate fiber of the present invention comprises a naphthalate-based copolyester in which at least 85 mol % or more of the total of recurring units is an ethylene 2,6-naphthalate unit, and it is obtained by copolymerizing an alkylene oxide adduct of a divalent phenol expressed by the following general formula (I) in an amount of 1 to 15 mol % as a part of the diol component.

$$H—(OA)_m—O—Ar—O—(AO)_n—H \quad (I)$$

In the formula, A expresses an alkylene group having a carbon number of 2 to 4, m and n are same as or different from each other, and each express an integer of 1 to 5, and Ar expresses a p-phenylene group, an m-phenylene group or a group of the following general formula (II)

$$—Ph—X—Ph— \quad (II)$$

In the formula, Ph expresses a p-phenylene group, and X expresses a 2,2-propylene group, a sulfone group, a methylene group, an oxygen atom or a sulfur atom.

This fiber has high retention ratios of tensile strength and knot strength, and is excellent in durability, and the fiber is suited for applications such as a dryer canvas for papermaking which is used under severe conditions in which especially wet heat treatments and dry heat treatments are repeated.

7 Claims, No Drawings

POLYETHYLENE NAPHTHALATE FIBER

TECHNICAL FIELD

The present invention relates to a polyethylene naphthalate fiber. More specifically, it relates to a polyethylene naphthalate fiber capable of exhibiting excellent durability even when used under conditions where the fiber is subjected to a wet heat treatment or a dry heat treatment and, for example, useful as a material for an industrial application such as a dryer canvas for papermaking.

BACKGROUND ART

Heretofore, polyester fibers have been used in various applications due to their excellent properties. But, polyester fibers for industrial applications are often used under severe conditions of high temperature and high humidity from the properties of their applications, and their properties are not satisfactory.

Polyester fibers, especially, for a dryer canvas which is used in a drying process in papermaking, a steel washing blush or the like are required to have sufficient durability for the long use under high temperature and high humidity. However, polyester fibers have had problems, namely in a high-temperature atmosphere in the presence of water, polyesters, especially polyethylene terephthalate, are apt to decompose, and accordingly to lower the degrees of polymerization to weaken a breaking strength, a knot strength and the like of the fibers, and they can not be used for a long time under high temperature and high humidity.

In order to solve these problems, various methods have been studied. For example, Japanese Examined Patent Publication No. 47-15104 proposes a process wherein the concentration of carboxyl terminal groups of polyethylene terephthalate is lowered by adding a combination of a copper salt of a carboxylic acid and a reductive anion. However, this process has such a disadvantageous point that when the above-mentioned stabilizer is added, the polyester is colored in an unfavorable color tone, and further, sufficient durability is not always obtained under severe conditions of high temperature and high humidity.

On the other hand, it is widely known that the use of polyethylene naphthalate, which has naphthalene rings in the molecular skeleton, in stead of polyethylene terephthalate can improve the durability of the fiber.

For example, there are Japanese Examined Patent Publication No. 47-49769, Japanese Examined Patent Publication No. 47-49770, Japanese Examined Patent Publication No. 56-42682, Japanese Unexamined Patent Publication No. 4-100914 and Japanese Unexamined Patent Publication No. 4-194021 regarding polyethylene 2,6-naphthalate fiber, and they describe that polyethylene naphthalate fibers having excellent mechanical properties and thermal stability are produced by specifying the conditions of melt spinning of polyethylene 2,6-naphthalate.

It is known that the polyethylene 2,6-naphthalate fiber can have a higher elastic modulus and tensile strength than the polyethylene terephthalate fiber, which is used widely conventionally, and the polyethylene 2,6-naphthalate fiber is good in resistance to wet heat because it has a high glass transition temperature. As a method for further improving the resistance to wet heat, for example, Japanese Unexamined Patent Publication No. 50-95517, Japanese Unexamined Patent Publication No. 56-85704 and the like disclose methods for reducing concentrations of carboxyl terminal groups of polyesters by adding a carbodiimide compound.

However, when these methods are applied, hydrolytic decomposition resistance is improved, but whitening, cracking and fibrillation on bending, which are problems characteristic to naphthalate-based polyester fibers, still occur and proceed not only under a wet heat condition but also under a dry heat condition. These methods therefore are not effective for solving these problems.

That is, since polyethylene 2,6-naphthalate has a rigid molecular chain and a characteristic crystal structure, whitening is apt to occur on a bent part when the fiber is subjected to deformation accompanied by bending such as knotting or the like, and fibrillation and cracking proceed from the whitened part, and resultingly a knot strength and a loop strength are lost especially in the fiber which has a single fiber fineness of 10 denier or more, or which has been kept under high temperature and high humidity for a long time. This has remained as a problem.

DISCLOSURE OF THE INVENTION

The object of the present invention is to provide a polyester filament, especially its monofilament, satisfying both a bending fatigue durability under wet heat and dry heat, and mechanical properties such as a knot strength, a loop strength and the like at the same time while keeping the characteristic advantageous points of a naphthalate-based polyester, and capable of exhibiting excellent durability even in the application used under severe conditions in which dry heat treatments and wet heat treatments are repeatedly applied as in a dryer canvas for papermaking.

In order to achieve the above-mentioned object, the inventors of the present invention had studied the causes of whitening, cracking and fibrillation on bending which are characteristic phenomena to the naphthalate-based polyester fiber, and they found that the breakage of fibers by compression deformation in the direction of fiber axis causes the phenomena. That is, they made clear that since the naphthalate-based polyester has a characteristic crystal structure, the fiber structure can not sufficiently relieve compression stress against compression deformation, and resultingly the compression stress breaks the fiber and causes whitening, cracking and fibrillation to lower the durability, and they further found that the phenomena can be suppressed without deteriorating the advantageous points characteristic to the naphthalate-based polyester by copolymerizing an alkylene oxide adduct of a phenol with a naphthalate-based polyester. Thus, the present invention has been completed.

That is, the polyethylene naphthalate fiber which can achieve the object of the present invention is characterized in that the fiber comprises a naphthalate-based copolyester in which at least 85 mol % or more of the total recurring units is an ethylene 2,6-naphthalate unit, and 1 to 1.5% of the total diol components is an alkylene oxide adduct of a divalent phenol expressed by the following general formula (I).

$$H—(OA)_m—O—Ar—O—(AO)_n—H \quad (I)$$

In the formula, A expresses an alkylene group having a carbon number of 2 to 4; m and n are same as or different from each other, and each express an integer of 1 to 5; and Ar expresses a p-phenylene group, a m-phenylene group or a group expressed by the following general formula (II).

$$—Ph—X—Ph— \quad (II)$$

In the formula, Ph expresses a p-phenylene group; and X expresses a 2,2-propylene group, a sulfone group, a methylene group, an oxygen atom or a sulfur atom.

BEST MODE FOR CARRYING OUT THE INVENTION

The naphthalate-based copolyester constituting a fiber of the present invention consists of an ethylene 2,6-naphthalate unit in an amount of at least 85 mol % or more of the total of the recurring units, and it is a copolyester obtained by copolymerizing a compound expressed by the above general formula (I), that is, an alkylene oxide adduct of a divalent phenol as a part of the diol component.

In the above general formula (I), A expresses an alkylene group having a carbon number of 2 to 4, and an ethylene group is especially preferred; and m and n are same as or different from each other, and they each express an integer of 1 to 5, preferably an integer of 1 to 3, especially preferably an integer of 1 to 2. When m or n exceeds 5, favorable properties of high strength, high elastic modulus and high glass transition temperature, which are characteristic to the naphthalate-based polyester, are lost.

Further, Ar is a p-phenylene group, a m-phenylene group or a group expressed by the above general formula (II), and in the general formula (II), Ph expresses a p-phenylene group; and X expresses a 2,2-propylene group, a sulfone group, a methylene group, an oxygen atom or a sulfur atom. Especially, Ar is preferably expressed by the general formula (II) in which X is a 2,2-propylene group or a sulfone group, especially a 2,2-propylene group.

The copolymerization ratio of the alkylene oxide adduct of the divalent phenol is in the range of 1 to 15 mol %, preferably 2 to 10 mol %, especially preferably 3 to 7 mol % based on the total diol components. When the copolymerization ratio is less than 1 mol %, the effect of copolymerization of the compound is not exhibited. On the other hand, when the ratio exceeds 15 mol %, the advantageous points of the naphthalate-based polyester are unfavorably lost, that is, the strength of a fiber is lost, or the like.

Further another copolymerization component may be copolymerized with the above-mentioned naphthalate-based copolyester. Main examples of the copolymerization component include dicarboxylic acid components such as terephthalic acid, isophthalic acid and the like, diol components such as trimethylene glycol, tetramethylene glycol, hexamethylene glycol, 1,4-cyclohexanediol and the like, and the like, and other known components can be arbitrarily used.

The intrinsic viscosity of the naphthalate-based copolyester is suitably in the range of 0.45 to 1.5, preferably 0.55 to 1.5. The intrinsic viscosity used here is measured at 35° C. using o-chlorophenol as a solvent. When the intrinsic viscosity is less than 0.45, mechanical properties of the fiber, especially the monofilament, are low, and durability in a wet heat treatment or a dry heat treatment is poor. On the other hand, when the intrinsic viscosity exceeds 1.5, the melt viscosity is high, and thereby the fluidity is insufficient, and it is difficult to spin the naphthalene-based copolyester into a homogeneous fiber.

Further, it is preferred from view points of melt stability during melt spinning and the hydrolytic resistance of the fiber to be obtained that the naphthalate-based copolyester has the concentration of carboxyl terminal groups of not larger than 40 equivalent/ton, preferably not larger than 30 equivalent/ton, especially preferably not larger than 20 equivalent/ton.

Next, to the naphthalate-based copolyester of the present invention may be added an additive commonly compounded to a polyester fiber, for example, inorganic particles such as titanium oxide, silicon oxide, calcium carbonate, talc or the like, or a known stabilizer, ultraviolet absorbent, antioxidant, antistatic agent, pigment, wax, silicone oil or surfactant, or the like. Further, a polyester other than the above-mentioned naphthalate-based copolyester, a polyamide, a polyether-ester, a polyurethane, a polycarbonate, a polyarylate, a fluorine-contained resin or the like may optionally be mixed in a small amount at need.

The naphthalate-based copolyester of the present invention can be produced in accordance with a conventionally used method. For example, 2,6-naphthalenedicarboxylic acid or its dimethyl ester, ethylene glycol and the alkylene oxide of the above-mentioned divalent phenol are mixed each in a specified amount, and the mixture is subjected to a heat reaction at atmospheric pressure or under reduced pressure. In this process, an additive such as a catalyst can be used arbitrarily at need.

The polyethylene naphthalate fiber of the present invention is a fiber comprising the above-mentioned naphthalate-based copolyester, and the effect of the present invention is remarkable when the present invention relates to a fiber having the single fiber fineness of 5 denier or more, or preferably 10 denier or more. When the fiber is a multifilament, it is not necessary to specifically limit the total fineness, and the total fineness can be arbitrarily decided depending on its usage. On the other hand, when the fiber is a monofilament, a monofilament having the fineness of 10 to 13,000 denier, especially 300 to 10,000 denier advantageously exhibits the effect of the present invention in a remarkable manner. The shape of the cross section of the fiber may be a circle, but it can be arbitrarily selected from other cross sections such as triangle, square, polygon and the like at need.

Further, it is preferred that the polyethylene naphthalate fiber of the present invention has a knot strength retention ratio of 70% or more, and a tensile strength retention ratio of 70% or more. When these ratios are smaller than 70%, the durability on use sometimes widely lowers in an application of, for example, a dryer canvas for papermaking or the like, which is used under extremely severe conditions. Here, the knot strength retention ratio is a value determined from knot strengths measured before and after the fiber is subjected to a wet heat treatment in an autoclave of 140° C. for 60 hr, and the tensile strength retention ratio is a value determined from tensile strengths measured before and after the fiber is subjected to a wet heat treatment in an autoclave of 135° C. for 40 hr.

The above-mentioned polyethylene naphthalate fiber of the present invention can be produced by subjecting the above-mentioned naphthalate-based copolyester to melt spinning, drawing and optionally a heat treatment according to conventionally used methods. For example, a dried naphthalate-based copolyester is melt spun through a spinneret at a temperature in the range of the melting point to the melting point+70° C., and the spun fiber is cooled to solidify and then taken up at an appropriate speed to obtain an undrawn fiber. Further, a carboxyl terminal group-blocking agent such as a carbodiimide compound or the like is preferably added to the polymer when it is molten, since the addition can suppress the decrease of the intrinsic viscosity and improve the durability of the fiber to be obtained.

The number of the hole of the melt-spinning spinneret can be one; however, a method in which the polymer is spun simultaneously through multi holes, and the spun fibers are separately taken-up is preferable, since this method has high productivity, and at the same time the lowering of the intrinsic viscosity of the fiber to be obtained is small.

The obtained undrawn fiber is subjected to a drawing-heat treatment at an appropriate draw ratio depending on the taking-up speed of the spun fiber and the properties required for the drawn fiber to be obtained. When the draw ratio is too low, the tensile strength is low; and on the other hand, when it is too high, the tensile strength is high, but the flexing properties are poor and the knot strength tends to be low.

EXAMPLES

The present invention will be explained further in detail hereafter with examples. Characteristic properties in examples and comparative examples are determined in the following methods.

<Tensile strength, knot strength and loop strength>

These strengths are determined according to JIS L1013 at sample length of 20 cm and an extension speed of 100%/min.

<Wet heat knot strength retention ratio>

A polyester fiber is treated in an autoclave filled with saturated steam of 140° C. for 60 hr, the knot strength of the fiber after the treatment is divided with the knot strength of the fiber before the treatment, and the result is multiplied by 100 to obtain the objective ratio.

<Wet heat tensile strength retention ratio>

A polyester fiber is treated in an autoclave filled with saturated steam of 135° C. for 40 hr, the tensile strength of the fiber after the treatment is divided with the tensile strength of the fiber before the treatment, and the result is multiplied by 100 to obtain the objective ratio.

<Durability>

A polyester monofilament is treated in an autoclave filled with saturated steam of 140° C. for 60 hr, the monofilament after the treatment is pinched at a pinching pressure of 3 kg/cm$^2$, and the presence of cracks generated is examined. The case of the absence of crack is rated 1, the case where the generation of crack is suppressed by the protection of the pinching part with a buffering material is rated 2, and the case where the generation of crack is not suppressed is rated 3.

Example 1

A reaction apparatus provided with a distillation apparatus were charged with 244 parts by weight of dimethyl 2,6-naphthalenedicarboxylate, 118 parts by weight of ethylene glycol, 14.6 parts by weight of 2,2-bis[4-(2-hydroxyethoxy) phenyl]propane and 0.0613 part by weight of manganese acetate tetrahydrate, the temperature was elevated, and an ester exchange reaction was carried out while methanol was removed by distillation. After 2 hours, almost theoretical amount of methanol had been removed by distillation, and the ester exchange reaction was completed. At this time, the temperature inside the reaction system had reached 240° C. The ester exchange reaction mixture was transferred to a reaction apparatus provided with a stirrer, a nitrogen inlet, a pressure-reducing opening and a distillation apparatus. Into the reaction mixture were added 0.027 part by weight of phosphoric acid and 0.079 part by weight of antimony trioxide, and the gas inside the reaction apparatus was displaced with nitrogen. Then, the temperature of the mixture was elevated up to 290° C., polycondensation reaction was carried out at normal pressure for about 30 min, at 15 to 20 mmHg for about 30 min, and further at 0.05 to 0.5 mmHg for about 40 min. The intrinsic viscosity, melting point and glass transition temperature of the obtained polymer are shown in Table 1.

The obtained copolyester was made into chips and dried, and then the tips were melt-spun through a six-hole spinneret of 0.27 mm in the diameter of a hole at 310° C., and the spun fibers was cooled to solidify and once taken up at a speed of 400 m/min. The obtained undrawn fiber was drawn on a roller heated at 150° C. at a draw ratio of 6.0, and subsequently the fiber was treated on a hot plate heated at 240° C. under constant length to obtain a drawn fiber of 70 denier and 6 filaments. The evaluation values of the obtained drawn yarn are shown in Table 1.

Examples 2 and 3

Processes were carried out as in Example 1 except that 1,4-bis(2-hydroxyethoxy)benzene (Example 2) or 1,3-bis(2-hydroxyethoxy)benzene (Example 3) each in an amount shown in Table 1 was used in stead of 2,2-bis[4-(2-hydroxyethoxy)phenyl]propane. The results are shown also in Table 1.

Comparative Example 1

Processes were carried out as in Example 1 except that polyethylene naphthalate was produced by using ethylene glycol in an amount of 124 parts by weight without adding 2,2-bis[4-(2-hydroxyethoxy)phenyl]propane. The results are shown in Table 1.

Comparative Example 2

Processes were carried out as in Example 1 except that 1,3-bis(2-hydroxyethoxy)-2,2-dimethylpropane in an amount shown in Table 1 was used in stead of 2,2-bis[4-(2-hydroxyethoxy)phenyl]propane. The results are shown in Table 1.

TABLE 1

| | Example | | | Comparative Example | |
|---|---|---|---|---|---|
| | 1 | 2 | 3 | 1 | 2 |
| copolymer component | a | b | c | — | d |
| copolymerization ratio mol % | 5 | 5 | 5 | — | 10 |
| intrinsic viscosity | 0.69 | 0.67 | 0.66 | 0.64 | 0.65 |
| glass transition temperature ° C. | 114 | 115 | 116 | 122 | 105 |
| melting point ° C. | 255 | 254 | 254 | 266 | — |
| tensile strength g/de | 6.1 | 6.2 | 6.0 | 6.5 | 5.7 |
| elongation % | 15.7 | 15.1 | 15.5 | 9.5 | 16.2 |
| knot strength g/de | 4.1 | 3.9 | 4.0 | 2.9 | 4.0 |
| tensile strength retention ratio % | 82 | 85 | 80 | 90 | 63 |
| knot strength retention ratio % | 73 | 77 | 72 | 84 | 35 |

The a to d in the raw of the copolymerization component are each defined as follows.

a:2,2-bis[4-(2-hydroxyethoxy)phenyl]propane b:1,4- bis(2-hydroxyethoxy)benzene c:1,3- bis(2-hydroxyethoxy)benzene d:1,3- bis(2-hydroxyethoxy) -2, 2-dimethylpropane

Example 4

The polymer obtained in Example 1 was subjected further to solid-phase polymerization to obtain a naphthalate-based copolyester having an intrinsic viscosity of 0.97. The copolyester was melt-spun through a spinneret having one hole of 2.5 mm in the diameter of the hole at 305° C., and the spun fiber was cooled to solidify and once taken up at a speed of 54 m/min. The obtained undrawn fiber was fed to a drawing-heat treatment apparatus provided with a feeding roller, a drawing roller, a winding roller and a non-contact type heater placed between the rollers, drawn at a draw ratio of 4.5 at 240° C. and then heat-set. Results of the evaluation of the obtained monofilament are shown in Table 2.

Example 5

Processes were carried out as in Example 4 except that a naphthalate-based copolyester having an intrinsic viscosity of 0.97 obtained by copolymerizing bis[4-(2-hydroxyethoxy)phenyl]sulfone in an amount of 5 mol % was used in stead of 2,2-bis[4-(2-hydroxyethoxy)phenyl] propane. Results of the evaluation of the obtained monofilament are shown in Table 2.

Comparative Examples 3 and 4

Processes were carried out as in Example 4 except that a polyethylene 2,6-naphthalate having an intrinsic viscosity of 0.62 (Comparative Example 3) or 0.97 (Comparative Example 4) was used. Results of the evaluation of the obtained monofilament are shown also in Table 2.

Comparative Example 5

Processes were carried out as in Example 4 by using polyethylene 2, (3-naphthalate-based copolyester obtained by copolymerizing phthalic anhydride as a copolymerization component in an amount of 3 mol % based on the total acid components. Results of the evaluation of the obtained monofilament are shown in Table 2.

Example 6

To the polymer used in Example 4 was chip-blended a carbodiimide compound (STABAXOL P100 made by Bayer A.G.) in an amount of 1.8% by weight. The blended chips were subjected to spinning, drawing (at a draw ratio of 4.4) and a heat treatment as in Example 4 to obtain a monofilament. Results of the evaluation of the obtained monofilament are shown in Table 2.

Comparative Example 6

To the same polyethylene naphthalate as used in Comparative Example 4 was chip-blended the carbodiimide compound in an amount of 1.8% by weight, and the blended chips were subjected to spinning, drawing and a heat treatment as in Example 6 to obtain a monofilament. Results of the evaluation of the obtained monofilament are shown in Table 2.

TABLE 2

| | | Example | | | Comparative Example | | | |
|---|---|---|---|---|---|---|---|---|
| | | 4 | 5 | 6 | 3 | 4 | 5 | 6 |
| intrinsic viscosity | | 0.97 | 0.97 | 0.97 | 0.62 | 0.97 | 0.97 | 0.97 |
| denier | | 1616 | 1580 | 1682 | 1675 | 1585 | 1643 | 1544 |
| tensile strength | g/de | 4.3 | 4.6 | 3.7 | 5.1 | 4.9 | 3.9 | 4.9 |
| tensile elongation | % | 21.0 | 20.0 | 21.0 | 17.0 | 17.0 | 21.0 | 17.0 |
| knot strength | g/de | 3.2 | 3.1 | 3.6 | 2.5 | 3.0 | 3.4 | 2.4 |
| loop strength | g/de | 3.4 | 3.7 | 3.4 | 2.1 | 2.0 | 2.6 | 1.6 |
| knot strength retention ratio | % | 76.1 | 71.4 | 83.9 | 8.0 | 58.2 | 44.5 | 65.1 |
| durability (breakage) | | 1 | 1 | 1 | 3 | 2 | 2 | 2 |

INDUSTRIAL FIELD OF APPLICATION

The polyethylene naphthalate fiber of the present invention comprises a naphthalate-based copolyester obtained by copolymerizing an alkylene oxide adduct of a divalent phenol as a part of the diol component, and thereby the orientation crystallization of the polymer caused during the process of drawing and a heat treatment has been suppressed. Resultingly, the development of brittleness against a stress in the direction perpendicular to the fiber axis is suppressed, the fiber is resistant to the development of whitening, cracking and fibrillation even the fiber (especially, in the case of monofilament) is bent, and further the retention ratios of tensile strength and knot strength are high even after the repeated applications of dry heat treatments and wet heat treatments; and thus, the fiber has extremely excellent durability. Therefore, the fiber can be used widely in various applications of industrial materials such as a drier canvas for papermaking, a screen gauze and the like.

What is claimed is:

1. A polyethylene naphthalate fiber comprising a naphthalate-based copolyester in which at least 85 mol % or more of the total of recurring units is an ethylene 2,6-naphthalate unit, and 1 to 15 mol % of the total of diol components is an alkylene oxide adduct of a divalent phenol expressed by the following general formula (I).

$$H—(OA)_m—O—Ar—O—(AO)_n—H \quad (I)$$

in the formula, A expresses an alkylene group having a carbon number of 2 to 4, m and n are same as or different from each other, and each express an integer of 1 to 5, and Ar expresses a p-phenylene group, an m-phenylene group or a group expressed by the following general formula (II).

$$—Ph—X—Ph— \quad (II)$$

in the formula, Ph expresses a p-phenylene group, and X expresses a 2,2-propylene group, a sulfone group, a methylene group, an oxygen atom or a sulfur atom.

2. A polyethylene naphthalate fiber of claim 1, wherein the alkylene oxide adduct of the divalent phenol is an alkylene oxide adduct of a bisphenol expressed by the following general formula (III).

$$H—(OA)_m—O—Ph—X—Ph—O—(AO)_n—H \quad (m)$$

in the formula, A expresses an alkylene group having a carbon number of 2 to 4, Ph expresses a p-phenylene group, X expresses a 2,2-propylene group, a sulfone group, a methylene group, an oxygen atom or a sulfur atom, m and n are same as or different from each other, and each express an integer of 1 to 5.

3. A polyethylene naphthalate fiber of claim 2, wherein the alkylene oxide adduct of the bisphenol is the ethylene oxide adduct of 2,2-bis(4-hydroxyphenyl)propane or bis(4-hydroxyphenyl)sulfone.

4. A polyethylene naphthalate fiber of claim 1, wherein the polyethylene naphthalate fiber is a multifilament whose single fiber fineness is 5 denier or more.

5. A polyethylene naphthalate fiber of claim 4, wherein the tensile strength retention ratio is 70% or more when the fiber has been subjected to a wet heat treatment at 135° C. for 40 hr.

6. A polyethylene naphthalate fiber of claim 1, wherein the polyethylene naphthalate fiber is a monofilament having a single fiber fineness of 10 to 13,000 denier.

7. A polyethylene naphthalate fiber of claim 6, wherein the knot strength retention ratio is 70% or more when the fiber has been subjected to a wet heat treatment at 140° C. for 60 hr.

* * * * *